US011156001B2

(12) United States Patent
Attebery, II

(10) Patent No.: US 11,156,001 B2
(45) Date of Patent: Oct. 26, 2021

(54) SYSTEM FOR MECHANICAL ATTACHMENT OF STONE VENEER TO STRUCTURES

(71) Applicant: Harold C Attebery, II, Granville, OH (US)

(72) Inventor: Harold C Attebery, II, Granville, OH (US)

( * ) Notice: Subject to any disclaimer, the term of this patent is extended or adjusted under 35 U.S.C. 154(b) by 0 days.

(21) Appl. No.: 15/949,954

(22) Filed: Apr. 10, 2018

(65) Prior Publication Data

US 2020/0354967 A1 Nov. 12, 2020

Related U.S. Application Data

(60) Provisional application No. 62/483,481, filed on Apr. 10, 2017.

(51) Int. Cl.
*E04F 13/08* (2006.01)
*E04F 13/14* (2006.01)

(52) U.S. Cl.
CPC ..... *E04F 13/0846* (2013.01); *E04F 13/14* (2013.01)

(58) Field of Classification Search
CPC ..... E04F 13/0846; E04F 13/0841; E04F 13/0889; E04F 13/0826; E04F 13/14
See application file for complete search history.

(56) References Cited

U.S. PATENT DOCUMENTS 6,279,286 B1 * 8/2001 Ichihashi ..... E04F 13/0826 248/218.4
6,460,311 B1 * 10/2002 Ito ..... E04F 13/0826 52/489.1
7,748,188 B2 * 7/2010 Ito ..... E04F 13/0846 52/506.06
9,470,000 B1 * 10/2016 Ochi ..... E04F 13/142
2005/0102944 A1 * 5/2005 Hikai ..... E04F 13/0846 52/511

(Continued)

FOREIGN PATENT DOCUMENTS

DE 19726426 A1 * 1/1998 ..... E04F 13/10
EP 2584114 A2 * 4/2013 ..... E04F 13/10

(Continued)

*Primary Examiner* — Christine T Cajilig
(74) *Attorney, Agent, or Firm* — The Richards Law Firm LLC; William B. Richards, Esq.

(57) ABSTRACT

A stone assembly for use on the exterior of building that includes a stone face attached to a mechanical mount that is easily fixed to the face of a wall using standard construction practices. The mount provides a space between the stone and the face of the exterior wall such that moisture is not trapped between the stone and the wall construction. The space allows water vapor to escape and liquid water to run down the face of the wall to escape at the flashing on the lower ledge of the wall. A clip useful for use in mounting stone to a wall of a structure may preferably include a primary surface, first and second legs each having a proximal end connected to the primary surface and distal ends extending from the primary surface, a spacer having a proximal end connected to the primary surface and a distal end extending from the primary surface, and at least two tabs connected at the distal end of the spacer the spacers being substantially perpendicular to the spacer. A wall including such a system is also disclosed.

23 Claims, 8 Drawing Sheets

(56) References Cited

U.S. PATENT DOCUMENTS

| | | | | |
|---|---|---|---|---|
| 2007/0151190 | A1* | 7/2007 | Huff | E04F 13/14 52/592.5 |
| 2016/0060878 | A1* | 3/2016 | Everhart, II | E04F 13/148 52/588.1 |

FOREIGN PATENT DOCUMENTS

| | | | | |
|---|---|---|---|---|
| FR | 735134 | A * | 11/1932 | E04F 13/0846 |
| FR | 2734589 | A1 * | 11/1996 | E04F 13/0846 |

* cited by examiner

SYSTEM FOR MECHANICAL ATTACHMENT OF STONE VENEER TO STRUCTURES

REFERENCE TO PREVIOUS APPLICATIONS

This Application is based upon Provisional Application U.S. 62/483,481 Filed Apr. 10, 2017 entitled System for Mechanical Attachment of Stone Veneer to Structures. All disclosures of the Provisional Application are herein incorporated by reference.

BACKGROUND

Decorative facings for commercial and residential properties have entered the market in recent years. Generally, these facings have been manufactured stone that is mounted to a pre-prepared surface stone has been used as well with mortar being the primary material for applying the stone to a structure. The use of mortar is often substantially more expensive than other preparation of the wall is required because the stone and mortar does not shed water that may migrate to the rear of the stone.

SUMMARY

The present invention relates to a stone assembly for use on the exterior of building that includes a stone face attached to a mechanical mount that is easily fixed to the face of a wall using standard construction practices. Preferably, the mount provides a space between the stone and the face of the exterior wall such that moisture is not trapped between the stone and the wall construction. The space allows water vapor to escape and liquid water to run down the face of the wall to escape at the flashing on the lower ledge of the wall. A clip useful for use in mounting stone to a wall of a structure may preferably include a primary surface, first and second legs each having a proximal end connected to the primary surface and distal ends extending from the primary surface, a spacer having a proximal end connected to the primary surface and a distal end extending from the primary surface, and at least two tabs connected at the distal end of the spacer the spacers being substantially perpendicular to the spacer. A wall including such a system is also disclosed. While the word stone is used, any similar building material such as brick, natural stone, manmade stone, composite, or other fascia may be used.

BRIEF DESCRIPTION OF THE DRAWINGS

A more complete appreciation of the invention and the many embodiments thereof will be readily obtained as the same becomes better understood by reference to the following detailed description when considered in connection with the accompanying drawings, wherein.

DETAILED DESCRIPTION

The present invention will now be described with occasional reference to the specific embodiments of the invention. This invention may, however, be embodied in different forms and should not be construed as limited to the embodiments set forth herein. Rather, these embodiments are provided so that this disclosure will be thorough and complete, and will fully convey the scope of the invention to those skilled in the art.

Unless otherwise defined, all technical and scientific terms used herein have the same meaning as commonly understood by one of ordinary skill in the art to which this invention belongs. The terminology used in the description of the invention herein is for describing particular embodiments only and is not intended to be limiting of the invention. As used in the description of the invention and the appended claims, the singular forms "a," "an," and "the" are intended to include the plural forms as well, unless the context clearly indicates otherwise.

Unless otherwise indicated, all numbers expressing quantities of ingredients, properties such as molecular weight, reaction conditions, and so forth as used in the specification and claims are to be understood as being modified in all instances by the term "about." Accordingly, unless otherwise indicated, the numerical properties set forth in the specification and claims are approximations that may vary depending on the desired properties sought to be obtained in embodiments of the present invention. Notwithstanding that the numerical ranges and parameters setting forth the broad scope of the invention are approximations, the numerical values set forth in the specific examples are reported as precisely as possible. Any numerical values, however, inherently contain certain errors necessarily resulting from error found in their respective measurements.

Figure 1A:
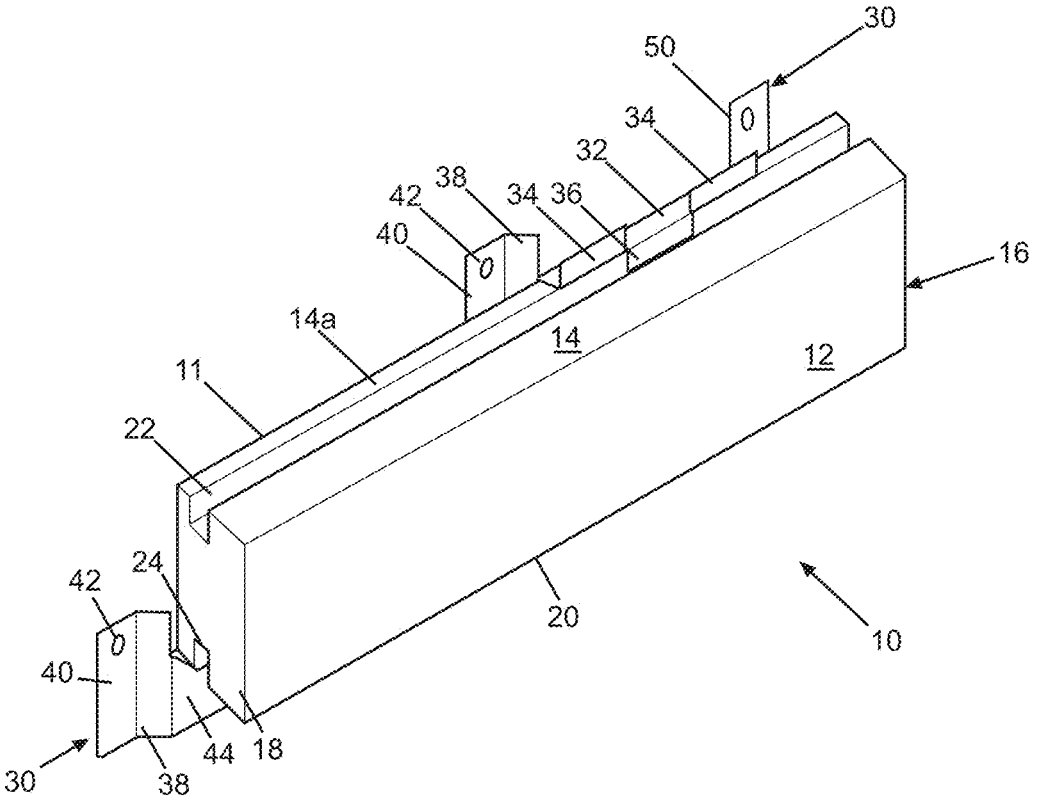
FIG. 1A illustrates a perspective view of a veneer stone mounted to a wall showing clips at the top and bottom of the stone, in accordance with the present invention.
Figure 2:
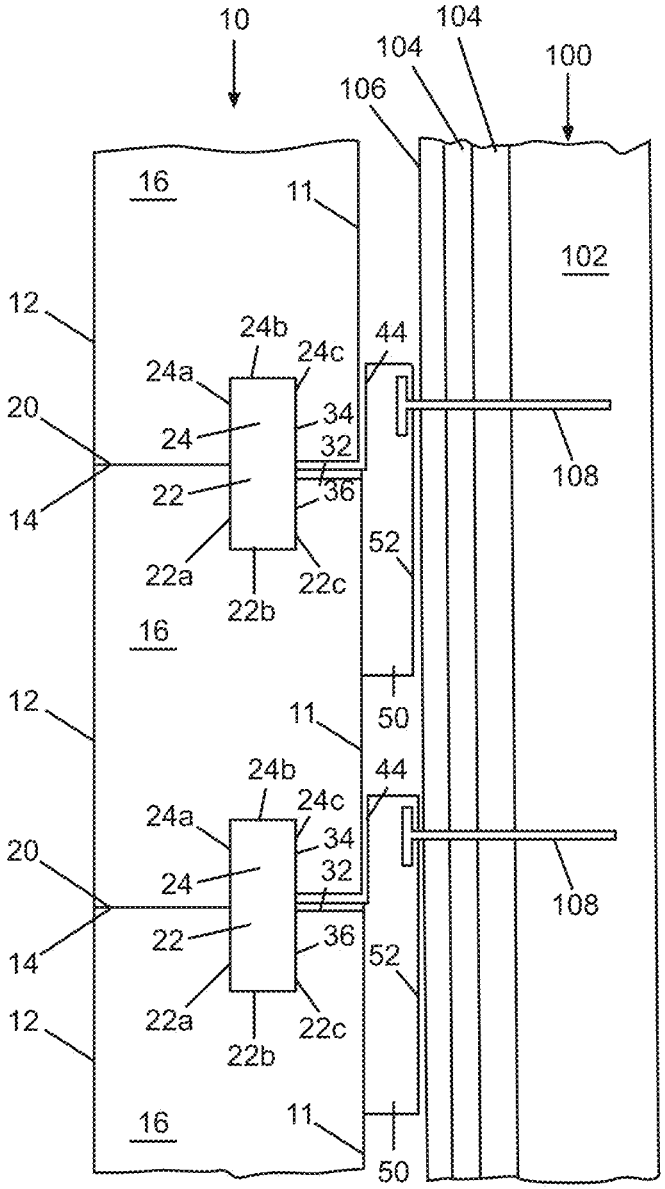
FIG. 2 illustrates a side plan view of a stone installation mounted to a wall showing clips at the top and bottom of the stone and a number of waterproofing layers between the stone and the wall, in accordance with the present invention.
Figure 3:
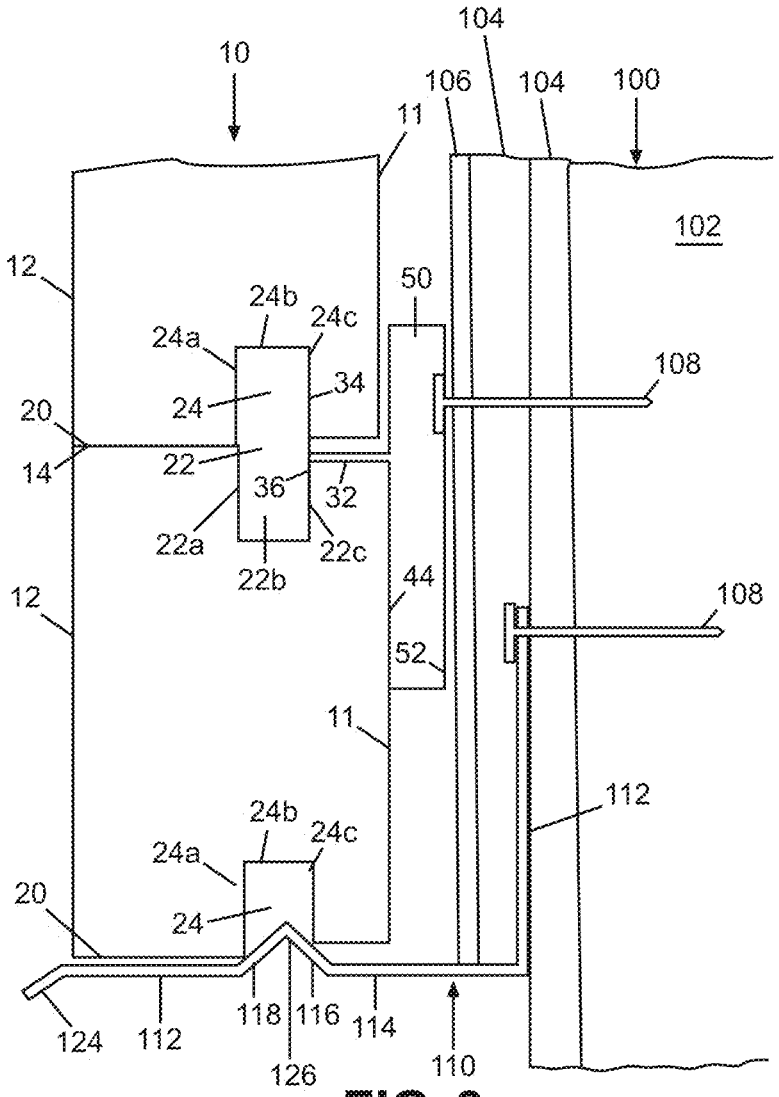
FIG. 3 illustrates a side plan view of a stone installation mounted to a wall showing clips at the top and bottom of the stone, a number of waterproofing layers between the stone and the wall and a weep screed/kick out flashing mounting rail.
Figure 4:
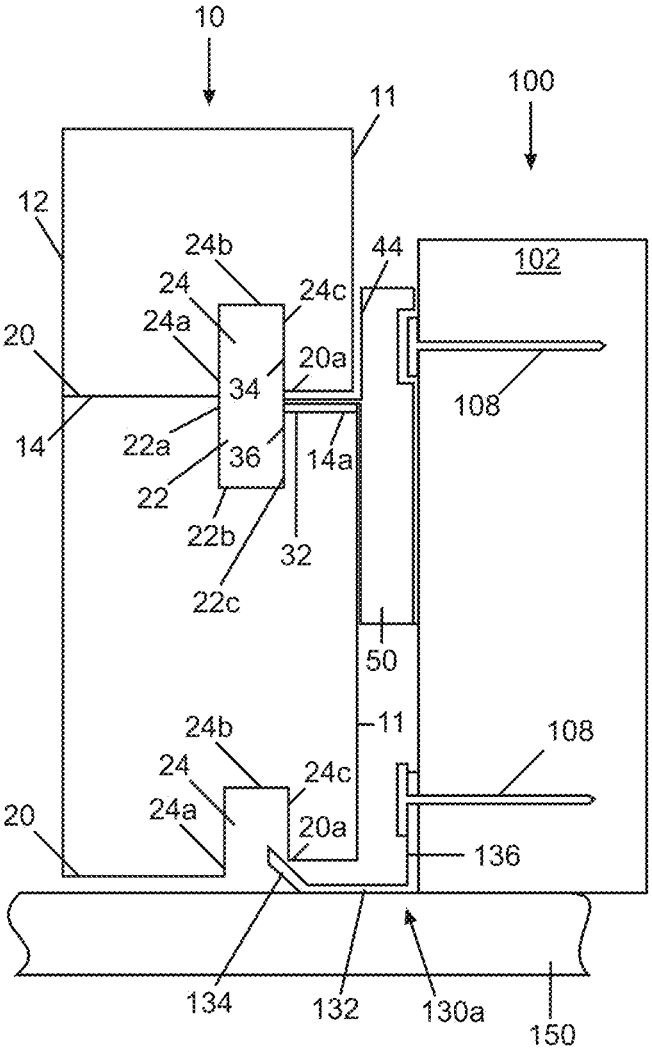
FIG. 4 illustrates a side plan view of a stone installation mounted to an interior wall showing clips at the top and bottom of the stone, and mounting rail intended to interior application.

As shown in FIG. 1A, the system for mechanical attachment of stone veneer to structures includes a slab of stone that is cut to a predetermined thickness and includes a feature cut into the stone that receives a mechanical mount. As shown in FIG. 1A, the mechanical mount is a metallic mount that may be stamped and formed. The feature cut in the stone, as shown in FIG. 1A, is a retaining feature such as groove cut in the top and bottom face of the stone. The mechanical mount includes spacers with tabs at the distal ends that contact the grooves at the top and bottom surface and a base section that is mounted to the wall of a structure. The mount may include raised footers that allow for the drainage of liquid water and vapor transport of any water vapor between the stone and the wall. Preferably, the top and bottom surfaces are cut at an angle (typically between about 5-30 degrees) to allow downward flow toward the front face of the stone to allow the stone to shed water when exposed to elements. The side faces are cut at angle (typically between about 5-30 degrees) such that when adjacent stones abut one another when mounted on the wall to inhibit the flow of water between the stones. The angled side faces of the stone also serve to improve the look of the stone surface when installed. While angled side faces may be preferred, some patterns of stone are typically presented with the side faces cut at right angles to the front face. Specifically, FIG. 1A shows a perspective view of a stone 10 for mounting to a wall having top surface 14, bottom surface 20, right surface 16, left surface 18, front face 12 and rear face 11. Stone 10 includes a retaining feature such as groove 22 on top surface 14 to form a secondary top surface 14*a*, which may be slightly lower than surface 14. Groove 24 on bottom surface 20 forms a secondary bottom surface, which may be slightly lower than surface 20. Clips 30 are generally formed by stamping from galvanized or stainless steel. Clips 30 preferably include a primary surface 44 that is raised from the wall assembly 100 (as shown in FIGS. 2-4) such that any liquid water that penetrates the stone façade may drain and any vapor may escape. Clip 30 is generally a single piece that is stamped and formed to include primary surface 44 with angled leg 38 and footer 40, with a screw hole 42 formed in footer 40. Clip 30 also includes a second angled leg 50, footer 52 and screw hole 42 opposite leg 38. Spacer 32 is formed substantially perpendicular to primary surface 44. The distal end of spacer 32 supports primary tabs 34, 36. Primary tabs 34, 36 engage grooves 22, 24 in top surface 14 and bottom surface 20.

Figure 1B:
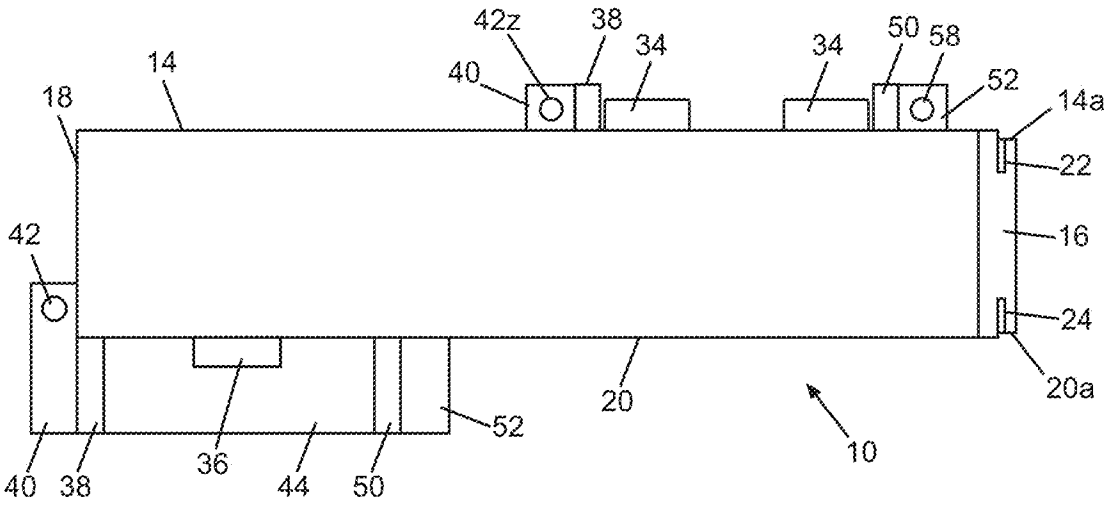
FIG. 1B illustrates a front plan view of a stone mounted to a wall showing clips at the top and bottom of the stone, in accordance with the present invention.

FIG. 1B shows a plan view of a stone 10, having top surface 14, bottom surface 20, right surface 16, left surface 18, front face 12 and rear face 11. Stone 10 includes groove 22 on top surface 14 to form a secondary top surface 14*a*, which may be slightly lower than surface 14. Groove 24 on bottom surface 20 forms a secondary bottom surface, which may be slightly lower than surface 20. Clips 30 are generally formed by stamping from galvanized or stainless steel. Clip 30 is generally a single piece that is stamped and formed to include primary surface 44 with angled leg 38 and footer 40, with a screw hole 42 formed in footer 38. Clip 30 also includes a second angled leg 50, footer 52 and screw hole 50 opposite leg 38. Spacer 32 is formed substantially perpendicular to primary surface 44. The distal end of spacer 32 supports primary tabs 34, 36. Primary tabs 34, 36 engage grooves 22, 24 in top surface 14 and bottom surface 20.

Figure 1C:
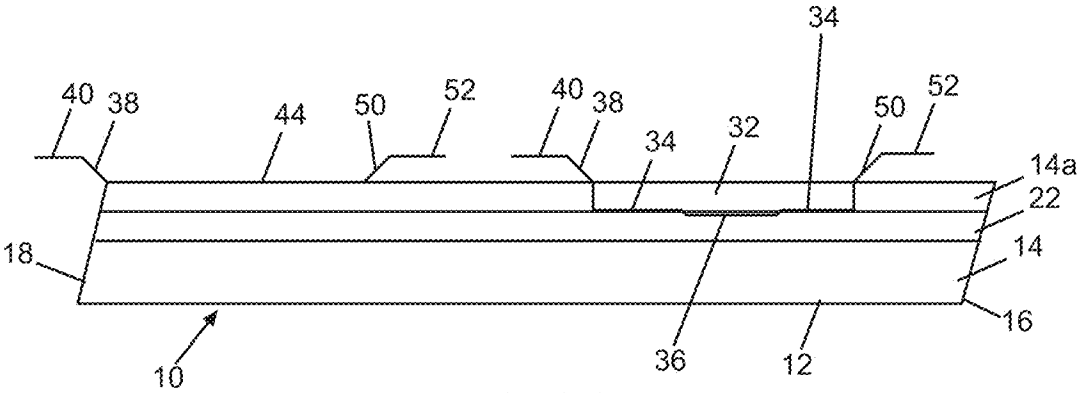
FIG. 1C illustrates a top plan view of a stone mounted to a wall showing clips at the top and bottom of the stone, in accordance with the present invention.

FIG. 1C shows a top plan view of a stone 10 for mounting to a wall having top surface 14, bottom surface 20, right surface 16, left surface 18, front face 12 and rear face 11. Stone 10 includes groove 22 on top surface 14 and form secondary top surface 14*a*. Clips 30 are generally formed by stamping from galvanized or stainless steel. Clip 30 is generally a single piece that is stamped and formed to include primary surface 44 with angled leg 38 and footer 40, with a screw hole 42 formed in footer 38. Clip 30 also includes a second angled leg 50, footer 52 and screw hole 50 opposite leg 38. Spacer 32 is formed substantially perpendicular to primary surface 44. The distal end of spacer 32 supports primary tabs 34, 36. Primary tabs 34, 36 engage grooves 22, 24 in top surface 14 and bottom surface 20.

As shown in FIG. 2, the wall system for mechanical attachment of stone veneer to structures includes a slab of stone that is cut to a predetermined thickness and includes a feature cut into the stone that receives a mechanical mount. Stone 10 is mounted to wall system 100 by any suitable mechanical attachment, such as nails, screws or staples 108. Specifically, FIG. 2 shows a plan view of a stone 10 for mounting to a wall system 100. Stone 10 includes top surface 14, bottom surface 20, right surface 16, left surface 18 (not shown), front face 12 and rear face 11. Stone 10 includes groove 22 on top surface 14 to form a secondary top surface 14*a*, which may be slightly lower than surface 14. Groove 24 on bottom surface 20 to forma secondary bottom surface, which may be slightly lower than surface 20. Clips 30 are generally formed by stamping from galvanized or stainless steel. Clip 30 is generally a single piece that is stamped and formed to include primary surface 44 with angled leg 38 and footer 40, with a screw hole 42 formed in footer 38. Clip 30 also includes a second angled leg 50, footer 52 and screw hole 50 opposite leg 38. Spacer 32 is formed substantially perpendicular to primary surface 44. The distal end of spacer 32 supports primary tabs 34, 36. Groove 22 is formed in the top surface 14 of stone 10. Groove 22 preferably includes front wall 22*a*, bottom wall 22*b* and rear wall 22*c*. Groove 24 is formed in the bottom surface 20 of stone 10. Groove 24 preferably includes front wall 24*a*, top wall 24*b* and rear wall 24*c*. Primary tabs 34, 36 of clip 30 engage grooves 22, 24 in stone 10. Spacer 32 is preferably slightly longer than the width of secondary surfaces 14*a*, 20 such that stone 10 may expand and contract without bending clip 30. Clips 30 are mounted to wall assembly 100 such that primary surface 44 is raised from wall assembly 100 and any liquid water that penetrates the stone façade may drain and any vapor may escape. Wall system preferably includes structural wall 102, preferably plywood or oriented strand board, to provide grip strength for mechanical attachment 108. Depending on local building code, a number of layers of moisture barrier 104, such as tar paper or a spun bond house wrap, such as Tyvek (available from DuPont) may be applied. A separate rain screen layer 106 may also be applied to create a capillary break and to enhance drainage and evaporation.

FIG. 3 shows the lower edge of the wall system for mechanical attachment of stone veneer of the present invention in an exterior application. The wall system may include a rail 110 having lower support 126 and kickout flashing 124. Rail 110 is intended to meet local building code and may vary by location, but generally includes a wall flashing 112 and lower support 114 having two raised walls to form support 126. Support 126 may be continuous along the length of the rail or may be formed in short raised sections. Support 126 may also be formed by piercing the lower support and bending a section upward to form a projection. Rail 110 may also include an outer support 122 with a kickout flashing 124 at the distal end. The kickout is required by some building codes to direct any water flowing down the wall away from the building foundation. Stone 10 is mounted to wall system 100 by any suitable mechanical attachment, such as nails, screws or staples 108. Specifically, FIG. 3 shows a plan view of a stone 10 for mounting to a wall system 100. Stone 10 includes top surface 14, bottom surface 20, right surface 16, left surface 18 (not shown), front face 12 and rear face 11. Stone 10 includes groove 22 on top surface 14 to form a secondary top surface 14*a*, which may be slightly lower than surface 14. Groove 24 on bottom surface 20 to forma secondary bottom surface, which may be slightly lower than surface 20. Clips 30 are generally formed by stamping from galvanized or stainless steel. Clip 30 is generally a single piece that is stamped and formed to include primary surface 44 with angled leg 38 and footer 40, with a screw hole 42 formed in footer 38. Clip 30 also includes a second angled leg 50, footer 52 and screw hole 50 opposite leg 38. Spacer 32 is formed substantially perpendicular to primary surface 44. The distal end of spacer 32 supports primary tabs 34, 36. Groove 22 is formed in the top surface 14 of stone 10. Groove 22 preferably includes front wall 22*a*, bottom wall 22*b* and rear wall 22*c*. Groove 24 is formed in the bottom surface 20 of stone 10. Groove 24 preferably includes front wall 24*a*, top wall 24*b* and rear wall 24*c*. Primary tabs 34, 36 of clip 30 engage grooves 22, 24 in stone 10. Spacer 32 is preferably slightly longer than the width of secondary surfaces 14*a*, 20 such that stone 10 may expand and contract without bending clip 30. Clips 30 are mounted to wall assembly 100 such that primary surface 44 is raised from wall assembly 100 and any liquid water that penetrates the stone façade may drain and any vapor may escape. Wall system preferably includes structural wall 102, preferably plywood or oriented strand board, to provide grip strength for mechanical attachment 108. Depending on local building code, a number of layers of moisture barrier 104, such as tar paper or a spun bond house wrap, such as Tyvek (available from DuPont) may be applied. A separate rain screen layer 106 may also be applied to create a capillary break and to enhance drainage and evaporation. In conformance with local code, flashing 112 of rail 110 may be attached to wall 102 by mechanical fastener 108. As shown one layer of moisture barrier 104 is placed under flashing 112 and additional layers of moisture barrier 104 and rain screen 106 may be placed over flashing 112 to inhibit water flow into the wall system 100.

FIG. 4 shows the lower edge of the wall system for mechanical attachment of stone veneer of the present invention in an interior application. The wall system may include a rail 130 having lower support 134. Rail 130 is intended to meet local building code and may vary by location, but generally includes a wall attachment section 136 and lower support 132 having support 134 at the distal edge thereof. Support 134 may be continuous along the length of the rail or may be formed in short raised sections. Stone 10 is mounted to wall system 100 by any suitable mechanical attachment, such as nails, screws or staples 108. Specifically, FIG. 4 shows a plan view of a stone 10 for mounting to a wall system 100. Stone 10 includes top surface 14, bottom surface 20, right surface 16, left surface 18 (not shown), front face 12 and rear face 11. Stone 10 includes groove 22 on top surface 14 to form a secondary top surface 14*a*, which may be slightly lower than surface 14. Groove 24 on bottom surface 20 to forma secondary bottom surface, which may be slightly lower than surface 20. Clips 30 are generally formed by stamping from galvanized or stainless steel. Clip 30 is generally a single piece that is stamped and formed to include primary surface 44 with angled leg 38 and footer 40, with a screw hole 42 formed in footer 38. Clip 30 also includes a second angled leg 50, footer 52 and screw hole 50 opposite leg 38. Spacer 32 is formed substantially perpendicular to primary surface 44. The distal end of spacer 32 supports primary tabs 34, 36. Groove 22 is formed in the top surface 14 of stone 10. Groove 22 preferably includes front wall 22*a*, bottom wall 22*b* and rear wall 22*c*. Groove 24 is formed in the bottom surface 20 of stone 10. Groove 24 preferably includes front wall 24*a*, top wall 24*b* and rear wall 24*c*. Primary tabs 34, 36 of clip 30 engage grooves 22, 24 in stone 10. Spacer 32 is preferably slightly longer than the width of secondary surfaces 14*a*, 20 such that stone 10 may expand and contract without bending clip 30. Clips 30 are mounted to wall assembly 100 such that primary surface 44 is raised from wall assembly 100 and any liquid water that penetrates the stone façade may drain and any vapor may escape. Wall system preferably includes structural wall 102, preferably plywood or oriented strand board, to provide grip strength for mechanical attachment 108. As FIG. 4 shows an internal application, moisture barrier and rain screen layer are not typically required. In conformance with local code, rail 130 may be attached to wall 102 by mechanical fastener 108 Floor 150 may also provide support for rail 130.

Figure 5:
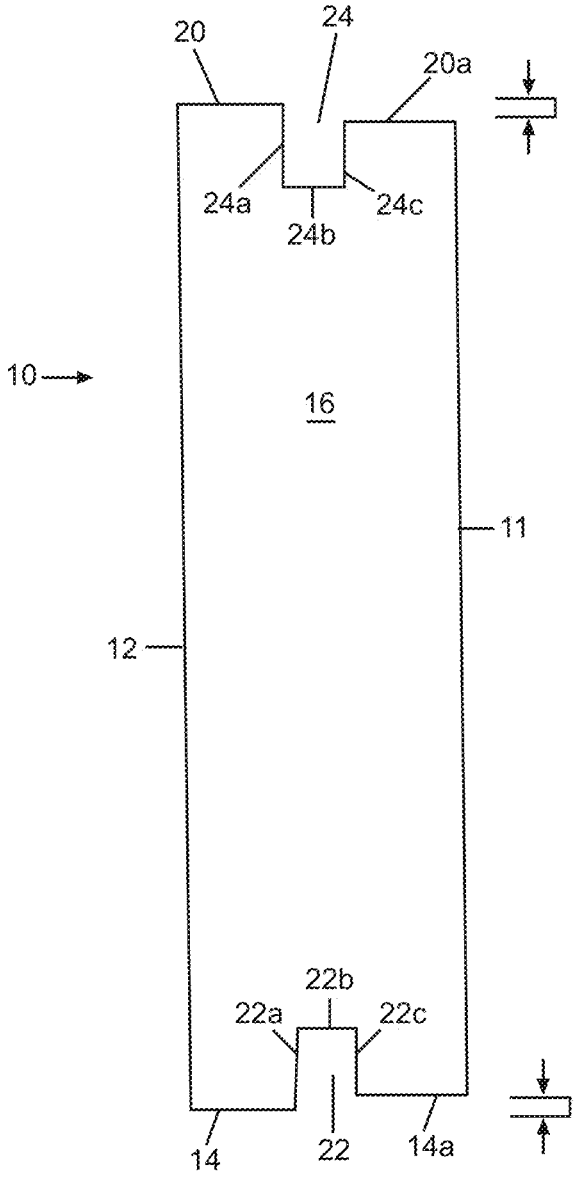
FIG. 5 illustrates a side plan view of a stone that is grooved on the top and bottom surface to engage a clip in each groove for mechanical attachment to a wall, in accordance with the present invention.

FIG. 5 shows the detail of stone 10 for use in the wall system of the present invention. Stone 10 includes front face 10, rear face 11, top surface 20, bottom surface 14, right surface 16 and left surface 18 (not shown). Upper groove 24 is formed in top surface 24 by routing, wire cutting or sawing. A circular saw with a carbide or diamond blade is particularly useful in grooving stone 10. Upper groove 24 includes a front face 24*a*, a bottom surface 24*b* and a rear surface 24*c*. Groove 24 forms a secondary upper surface 20*a* toward the rear of the stone. A relief cut may be included at secondary surface 20*a* such that surface 20 is higher than surface 20*a*. The relief cut allows spacer 32 of clip 30 to fit between adjacent stones 10 without causing a gap between the stones 10. Lower groove 22 includes a front face 22*a*, a bottom surface 22*b* and a rear surface 22*c*. Groove 22 forms a secondary upper surface 14*a* toward the rear of the stone. Alternatively, or additionally, a relief cut may be included at secondary surface 14*a* such that surface 14 is higher than surface 14*a*. The relief cut allows spacer 32 of clip 30 to fit between adjacent stones 10 without causing a gap between the stones 10.

Figure 6A:
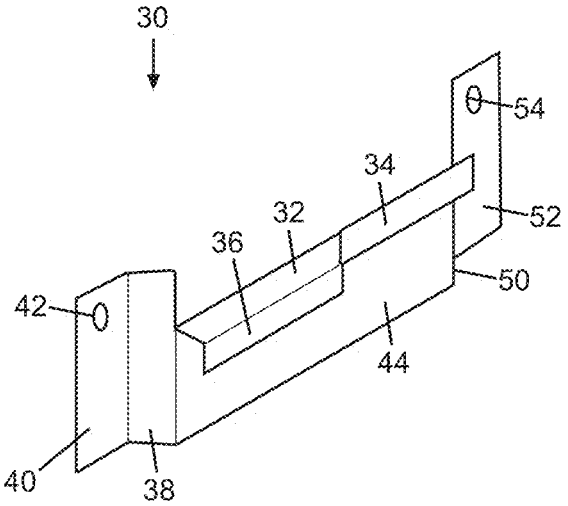
FIG. 6A illustrates a perspective view of a clip used for a stone installation on a wall.

FIG. 6A illustrates a clip 30' useful in the wall system of the present invention with a single downward tooth 36 and a single upward tooth 34, which is typically useful in interior or lower stress environments. Clip 30 is preferably formed by stamping from galvanized or stainless steel. Clip 30 is generally a single piece that is stamped and formed to include primary surface 44 with angled leg 38 and footer 40, with a screw hole 42 formed in footer 38. Clip 30 also includes a second angled leg 50, footer 52 and screw hole 50 opposite leg 38. Spacer 32 is formed substantially perpendicular to primary surface 44. The distal end of spacer 32 supports primary tabs 34, 36.

Figure 6B:
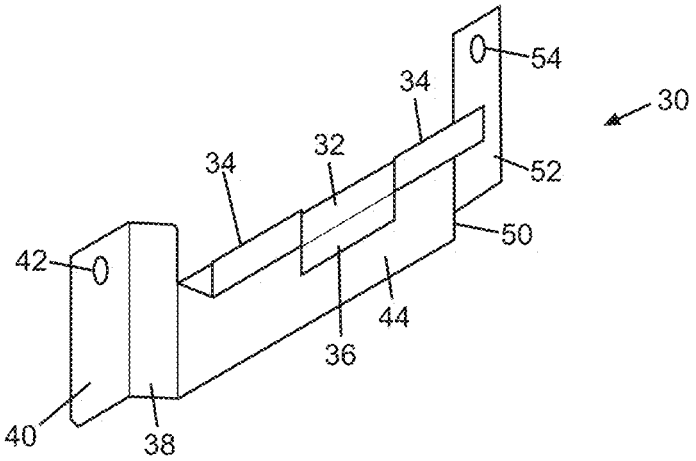
FIG. 6B illustrates a perspective view of another clip used for a stone installation on a wall.

FIG. 6B illustrates a clip 30 useful in the wall system of the present invention with a single downward tooth 36 and two upward teeth 34, which is typically useful in exterior and higher stress environments. Clips 30 are generally formed by stamping from galvanized or stainless steel. Clip 30 is generally a single piece that is stamped and formed to include primary surface 44 with angled leg 38 and footer 40, with a screw hole 42 formed in footer 38. Clip 30 also includes a second angled leg 50, footer 52 and screw hole 50 opposite leg 38. Spacer 32 is formed substantially perpendicular to primary surface 44. The distal end of spacer 32 supports primary tabs 34, 36.

Figure 6C:
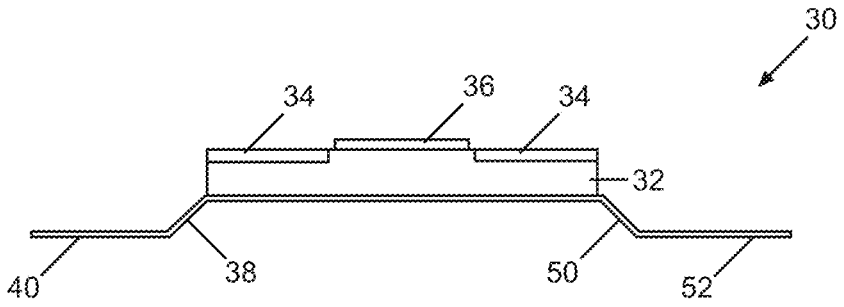
FIG. 6C illustrates a top plan view of a clip used for a stone installation on a wall.

FIG. 6C illustrates a clip 30 useful in the wall system of the present invention with a single downward tooth 36 and two upward teeth 34. Clips 30 include primary surface 44 with angled leg 38 and footer 40, with a screw hole 42 (not shown) formed in footer 38. Clip 30 also includes a second angled leg 50, footer 52 and screw hole 50 (not shown) opposite leg 38. Spacer 32 is formed substantially perpendicular to primary surface 44. The distal end of spacer 32 supports primary tabs 34, 36.

Figure 6D:
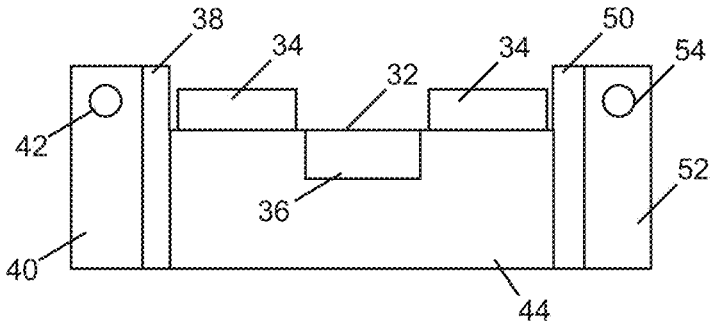
FIG. 6D illustrates a front plan view of a clip used for a stone installation on a wall.

FIG. 6D illustrates a clip 30 useful in the wall system of the present invention with a single downward tooth 36 and two upward teeth 34. Clips 30 include primary surface 44 with angled leg 38 and footer 40, with a screw hole 42 (not shown) formed in footer 38. Clip 30 also includes a second angled leg 50, footer 52 and screw hole 50 (not shown) opposite leg 38. Spacer 32 is formed substantially perpendicular to primary surface 44. The distal end of spacer 32 supports primary tabs 34, 36.

The present invention should not be considered limited to the specific examples described herein, but rather should be understood to cover all aspects of the invention. Various modifications, equivalent processes, as well as numerous structures and devices to which the present invention may be applicable will be readily apparent to those of skill in the art. Those skilled in the art will understand that various changes may be made without departing from the scope of the invention, which is not to be considered limited to what is described in the specification.

What is claimed is:

1. A system for mechanical attachment of stone veneer to structures, comprising:
- a slab stone of a predetermined thickness having:
  - a front and rear face, opposed top and bottom surfaces, side surfaces, and retaining features cut into the stone;
- a mechanical mount including:
  - a primary surface;
  - first and second legs, each leg having a proximal end connected to the primary surface and a distal end extending from the primary surface;
  - a projection having a distal end extending into the slab; and
  - tabs extending from the projection, said tabs formed to mate with the retaining features in the stone; and wherein when mounted on a wall, the mechanical mount, the stone, and the wall define an open channel, wherein the system allows for the free passage of moisture through the open channel, thereby avoiding the retention of moisture between the stone and the wall.

2. The system for mechanical attachment of stone veneer to structures of claim 1, wherein the retaining features are grooves cut in the top and bottom surface of the stone.

3. The system for mechanical attachment of stone veneer to structures of claim 1, wherein
- the first and second legs extend in a first direction from the primary surface; and wherein
- the projection extends in a second direction from the primary surface.

4. The system for mechanical attachment of stone veneer to structures of claim 1, wherein the mechanical mount further comprises: a footer formed on each leg.

5. The system for mechanical attachment of stone veneer to structures of claim 1, wherein the projection is formed substantially perpendicular to the primary surface.

6. The system for mechanical attachment of stone veneer to structures of claim 3, wherein the mechanical mount allows the escape of liquid water and vapor transport between the stone and the wall.

7. The system for mechanical attachment of stone veneer to structures of claim 1, wherein the side surfaces of the stone are cut at an angle between about 5-30 degrees.

8. The system for mechanical attachment of stone veneer to structures of claim 1, wherein the mount is stamped and formed from a single piece of metal.

9. A wall system with mechanical attached stone veneer, comprising:
- a wall;
- a stone of a predetermined thickness mounted to the wall, having:
  - a front and rear face,
  - opposed top and bottom surfaces,
  - side surfaces, and
  - retaining features cut into the stone;
- a mechanical mount attached to the wall including:
  - a primary surface,
  - at least one leg extending from the primary surface toward the wall,
  - a projection extending from the primary surface having a distal end extending into the stone, and
  - tabs extending from the projection, said tabs formed to mate with the retaining features in the stone, wherein the stone is retained to the wall and spaced apart from the wall and the mechanical mount, the stone, and the wall define an open channel, wherein the system allows for the free passage of moisture through the open channel, thereby avoiding the retention of moisture between the stone and the wall.

10. The wall system with mechanical attached stone veneer of claim 9, comprising: a footer formed on each leg.

11. The wall system with mechanical attached stone veneer of claim 9, wherein the projection is formed substantially perpendicular to the primary surface.

12. The wall system with mechanical attached stone veneer of claim 9, wherein the side surfaces of the stone are cut at an angle between about 5-30 degrees.

13. The wall system with mechanical attached stone veneer of claim 9, wherein the mount is stamped and formed from a single piece of metal.

14. A clip for mounting stone to a wall of a structure, comprising:
- a primary surface;
- first and second legs each having a proximal end connected to the primary surface and distal ends extending from the primary surface;
- a spacer having a proximal end connected to the primary surface and a distal end extending from the primary surface; and
- at least two tabs connected at the distal end of the spacer, the at least two tabs being substantially perpendicular to the spacer and wherein when mounting a slab of stone on a wall, the clip, the stone, and the wall define an open channel, wherein moisture passes freely through the open channel, thereby avoiding the retention of moisture between the stone and the wall.

15. The clip for mounting stone to a wall of a structure of claim 14, wherein the primary surface is substantially planar, and the spacer is substantially perpendicular to the primary surface.

16. The clip for mounting stone to a wall of a structure of claim 14, wherein the primary surface is substantially planar and the first and second legs are oblique to the primary surface.

17. The clip for mounting stone to a wall of a structure of claim 14, wherein the primary surface is substantially planar; the spacer is substantially perpendicular to the primary surface; and the first and second legs are oblique to the primary surface and in an opposite direction to the spacer.

18. The clip for mounting stone to a wall of a structure of claim 17, further comprising: a footer at the distal end of each leg.

19. The clip for mounting stone to a wall of a structure of claim 17, wherein the clip is formed of a single piece of metal.

20. The clip for mounting stone to a wall of a structure of claim 14, further comprising: a footer at the distal end of each leg.

21. The system for mechanical attachment of stone veneer to structures of claim 1, wherein each leg comprises a plane, each leg plane parallel to the primary surface.

22. The wall system with mechanical attached stone veneer of claim 9, wherein each leg comprises a comprises a plane, each leg plane parallel to the primary surface.

23. The clip of claim 14, wherein each leg comprises a plane, each leg plane parallel to the primary surface.

* * * * *